US010024055B1

(12) United States Patent
Jahn et al.

(10) Patent No.: US 10,024,055 B1
(45) Date of Patent: Jul. 17, 2018

(54) SUSPENDED CEILING SYSTEM INCLUDING PERIMETER MOLDING

(71) Applicant: Rockwool International A/S, Hedehusene (DK)

(72) Inventors: Peter G. Jahn, Palos Park, IL (US); Michael Corpolongo, Chicago, IL (US)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 15/671,437

(22) Filed: Aug. 8, 2017

(51) Int. Cl.
*E04B 9/30* (2006.01)
*E04B 9/12* (2006.01)
*E04B 9/18* (2006.01)

(52) U.S. Cl.
CPC ..... *E04B 9/30* (2013.01); *E04B 9/127* (2013.01); *E04B 9/18* (2013.01)

(58) Field of Classification Search
CPC ..... E04B 9/30; E04B 9/127; E04B 9/18
See application file for complete search history.

(56) References Cited

U.S. PATENT DOCUMENTS 2,585,727 A * 2/1952 Barton ..... E06B 1/62 52/717.06
3,375,630 A * 4/1968 Dail ..... E04B 9/065 52/144
3,969,864 A * 7/1976 Stephenson ..... E04B 9/02 52/475.1
4,991,373 A * 2/1991 Shaub ..... E04B 9/241 411/459
5,081,812 A * 1/1992 Reynolds ..... E04B 9/30 52/506.06
5,177,929 A * 1/1993 Reynolds ..... E04B 9/22 52/506.1
5,263,295 A * 11/1993 Laird ..... E04B 9/30 52/506.08
5,619,833 A * 4/1997 Neff ..... E04B 9/064 52/506.05
5,979,134 A * 11/1999 Neff ..... E04B 9/064 52/311.2
7,143,562 B2 12/2006 Krantz-Lilienthal et al.
7,578,106 B2 8/2009 Burns et al.
7,677,004 B2 3/2010 LaLonde
8,316,600 B2 * 11/2012 Wendt ..... E04B 9/30 52/287.1

(Continued)

FOREIGN PATENT DOCUMENTS

CA 2193762 A1 6/1998
CA 2706275 A1 6/2009

(Continued)

*Primary Examiner* — Rodney Mintz
(74) *Attorney, Agent, or Firm* — Cook Alex Ltd.

(57) ABSTRACT

A suspended ceiling system is described composed of a grid of tees, ceiling tiles supported on the tees, a perimeter molding supporting the tees and the tiles adjacent a wall to which the wall molding is secured. The perimeter molding has an elongated, longitudinally-extending metal body with a first vertical leg configured to be secured to a wall. A first horizontal leg extends from the lower end of the first vertical leg. A second vertical leg extends from the first horizontal leg and a second horizontal leg extends from the upper end of the second vertical leg toward the first vertical leg. The second horizontal leg includes a free end spaced from the first vertical leg.

10 Claims, 7 Drawing Sheets

(56) References Cited

U.S. PATENT DOCUMENTS

| | | | | |
|---|---|---|---|---|
| 9,187,898 | B1 | 11/2015 | Underkofler et al. | |
| 9,388,576 | B2 | 7/2016 | Bowen | |
| 2005/0217194 | A1 | 10/2005 | Krantz-Lilienthal et al. | |
| 2006/0005493 | A1* | 1/2006 | Burns | E04B 9/065 52/506.01 |
| 2006/0010812 | A1* | 1/2006 | Jones | E04B 9/068 52/506.07 |
| 2007/0283657 | A1 | 12/2007 | Pratt | |
| 2008/0229680 | A1* | 9/2008 | Jahn | E04B 9/067 52/105 |
| 2012/0137614 | A1* | 6/2012 | Wendt | E04B 9/30 52/506.07 |
| 2012/0167513 | A1* | 7/2012 | Ahren | E04B 9/068 52/506.07 |
| 2016/0289965 | A1 | 10/2016 | Bowen | |

FOREIGN PATENT DOCUMENTS

| | | | | |
|---|---|---|---|---|
| CA | 2894800 | A1 | 1/2016 | |
| WO | WO2009/073266 | A1 | 6/2009 | |
| WO | WO2016048679 | A1 | 3/2016 | |
| WO | WO-2017041810 | A1 * | 3/2017 | E04B 9/18 |

* cited by examiner

SUSPENDED CEILING SYSTEM INCLUDING PERIMETER MOLDING

BACKGROUND

The present application is directed to suspended ceiling systems and, more particularly to suspended ceiling systems have concealed or semi-concealed suspension grids.

Ceiling systems of the type comprising a rectangular suspension grid made up of elongated main runners, cross tees, and wall-mounted perimeter trim or molding, and lay-in panels or tiles, are well known. The main runners and cross tees typically have an inverted T-shaped cross section defining opposed flanges at the lower end for supporting the edges of the tiles or panels associated with the ceiling system.

In the construction and assembly of the suspension grid, the size of the cells for receiving the panels located at the perimeter of the grid system often have a length and/or width that is shorter than the nominal length and width dimensions of the ceiling panels to be used in the system. In such circumstances, it is common for the installer to cut the panels for the perimeter cells in the field to size, leaving an unfinished edge.

There is a style of ceiling panels for use in such grid systems in which the lower, visible faces of the ceiling panels are in a plane below that defined by the flanges of the grid members that support the panels. Some such panels have edges that, when the panel is supported on the grid, result in the grid members being concealed, or semi-concealed, by the panels.

When such ceiling panels are cut to size for installation at the perimeter of the suspension system, the perimeter moldings that are typically used permit the unfinished edges of the cut panels at the perimeter of the ceiling to become visible when the panels are installed in the suspension grid. This is aesthetically unpleasing, and the installer may need to paint or otherwise provide a finished surface to the cut edge of the perimeter panel.

By way of the present application, a grid assembly is provided for suspended ceiling systems in which the lower face of the ceiling panels is below the supporting flanges of the grid members in which the perimeter molding conceals the unfinished edges of the panels received in the perimeter cells of the grid assembly.

SUMMARY

There are several aspects of the present subject matter which may be embodied separately or together in the suspended ceiling systems described and claimed below, and the description of these aspects together is not intended to preclude the use of these aspects separately, or the claiming of such aspects separately or in different combinations, as set forth in the claims appended hereto.

In a first aspect, a perimeter molding is provided comprising an elongated, longitudinally-extending metal body. The molding includes a first generally planar vertical leg having an upper and lower end and configured to be secured to a wall; a first generally planar horizontal leg having a first end and a second end, and extending from the lower end of the first vertical leg, the lower end of the first vertical leg and the first end of the first horizontal leg intersecting at a first corner; a second generally planar vertical leg having a lower end and an upper end, and extending upwardly from the second end of the first horizontal leg, the second end of the first horizontal leg and the lower end of the second vertical leg intersecting at a second corner; and a second generally planar horizontal leg having a first end and a second end, and extending from the upper end of the second vertical leg toward the first vertical leg, the first end of the second horizontal leg and the upper end of the second vertical leg intersecting at a third corner, and the second end of the second horizontal leg being a free end spaced from the first vertical leg.

In a second aspect, the first vertical leg of the perimeter molding has a first vertical dimension and the second vertical leg of the perimeter molding has a second vertical dimension, the first vertical dimension being greater than the second vertical dimension.

In a third aspect, the upper end of the first vertical leg of the perimeter molding comprises a longitudinally extending stiffening element.

In a fourth aspect, the perimeter molding is part of a suspended ceiling system comprising a grid of tees, ceiling tiles supported on the tees, with the perimeter molding supporting the tees and the tiles adjacent a wall to which the wall molding is secured.

In a fifth aspect, the grid tees comprise opposed flanges at the lower ends thereof that are supported on the second horizontal leg of the perimeter molding.

In a sixth aspect, the ceiling tiles have a lower face that lie in plane below a first plane defined by the second horizontal leg of the perimeter molding and in or above a second plane defined by the first horizontal leg of the perimeter molding.

DESCRIPTION OF THE DRAWINGS

These aspects, as well as others, will become apparent upon reference to the accompanying drawings in which.

DETAILED DESCRIPTION

A more detailed description of the suspended ceiling system and perimeter molding in accordance with the present disclosure is set forth below. It should be understood that the description below of a specific construction is intended to be exemplary, and not exhaustive of all possible applications. Thus, the scope of the disclosure is not intended to be limiting, and should be understood to encompass variations or embodiments that would occur to persons of ordinary skill.

Figure 1:
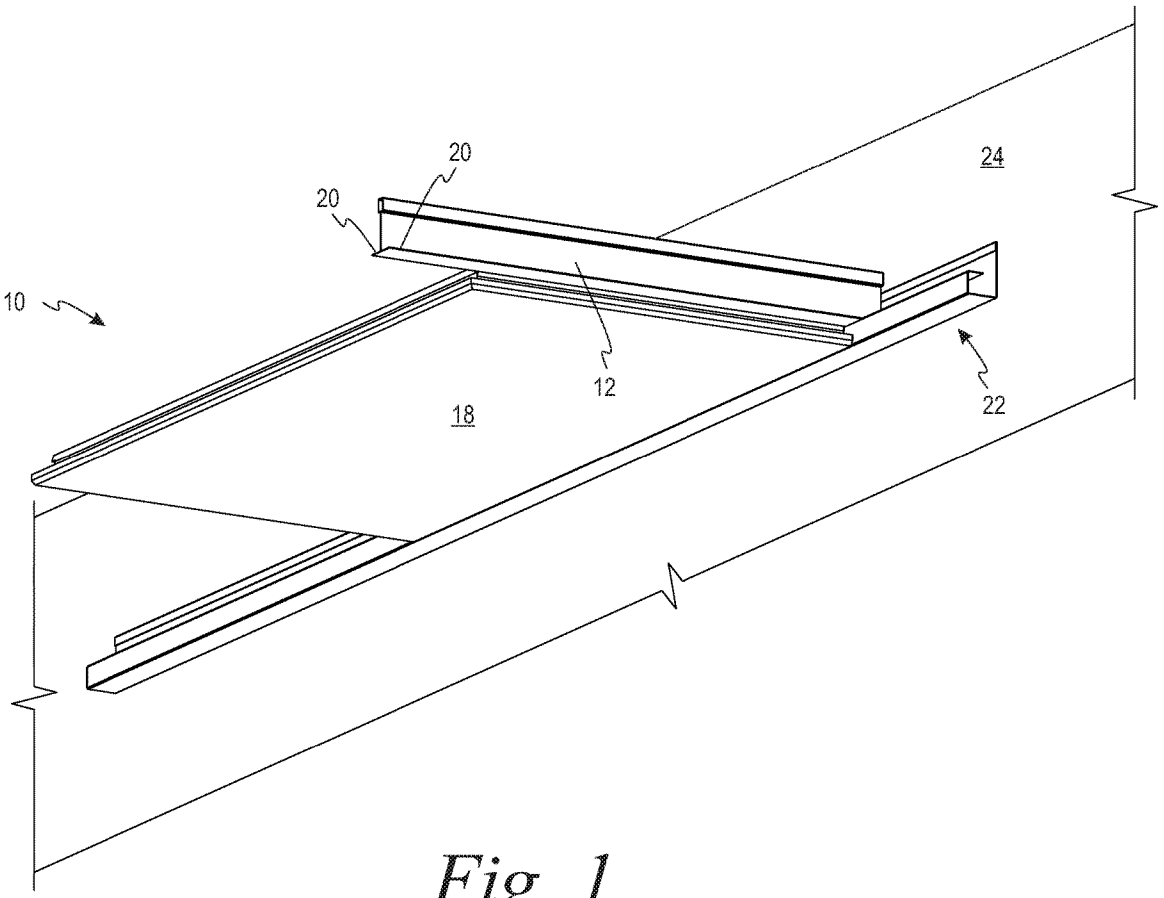
FIG. 1 is a perspective view of a suspended ceiling system in accordance with the present disclosure.
Figure 2:
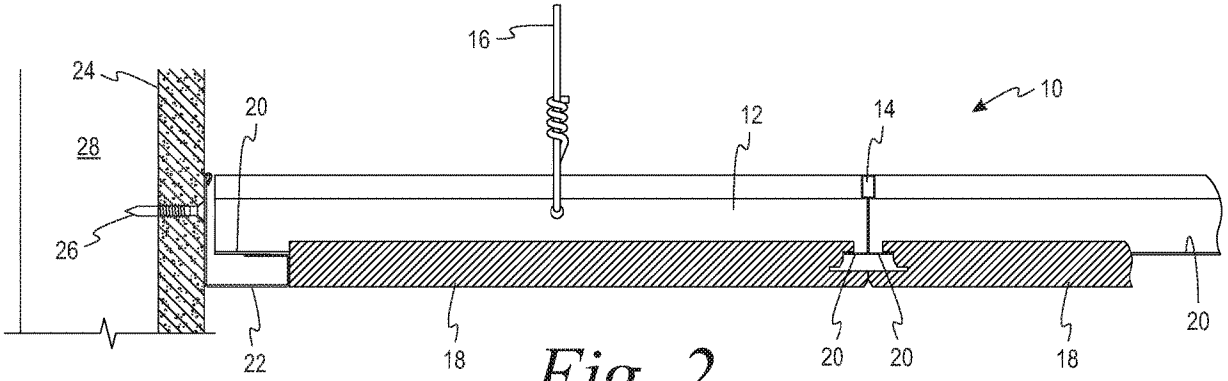
FIG. 2 is a fragmentary cross-sectional view in a vertical plane of a suspended ceiling system in accordance with the present disclosure in which the ceiling panels are configured to conceal the grid members.
Figure 3:
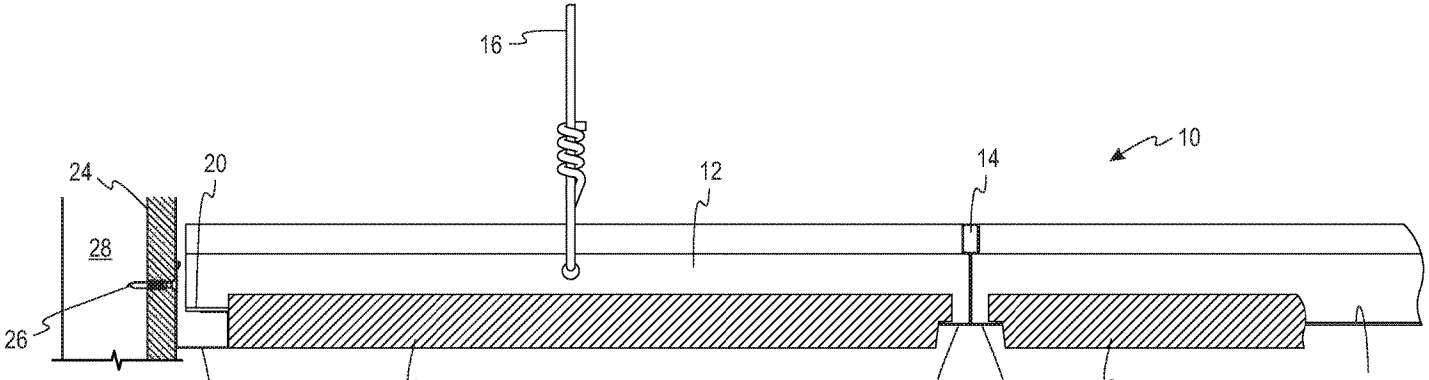
FIG. 3 is fragmentary cross-sectional view in a vertical plane of a suspended ceiling system in accordance with the present disclosure in which the lower face of the ceiling panels is below a plane defined by the grid members, but in which the ceiling panels are not configured to conceal the grid members.

Turning to the drawings, there is seen in FIGS. 1-3 a ceiling system 10 in accordance with the present disclosure. The system includes main runners 12 and cross tees 14, with the main runners 12 being supported from a structural ceiling (not shown) by hanger wires 16, as is well known in the art. The main runners 12 and cross tees 14 define cells for receiving individual ceiling panels 18. To this end, the main runners 12 and cross tees 14 typically have an inverted T cross section, with the opposed flanges 20 at the lower end supporting the edges of the associated ceiling panels 18.

A perimeter molding 22 is secured to a finished wall 24 by, e.g., screw fasteners 26. As seen in FIGS. 2 and 3, the screw fasteners 26 are located so as to screw into a structural wall member 28. The ends of the main runners 12 and cross tees 14 that extend to the perimeter are supported by the perimeter molding 22, with the flanges 20 of the main runners 12 and cross tees 14 resting on a horizontal leg of the perimeter molding 22.

Figure 4:
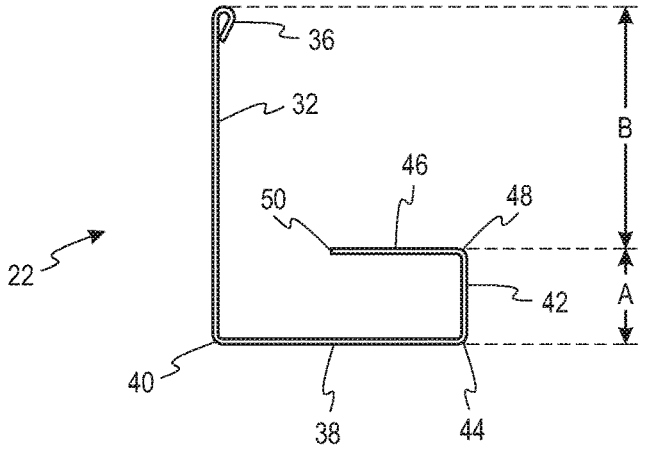
FIG. 4 is an end view of the perimeter molding used in the ceiling system of FIG. 2.
Figure 5:
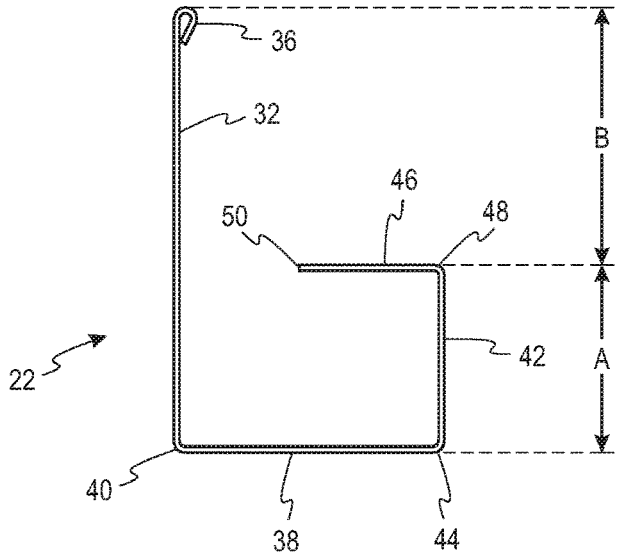
FIG. 5 is an end view of the perimeter molding used in the ceiling system of FIG. 3.
Figure 6:
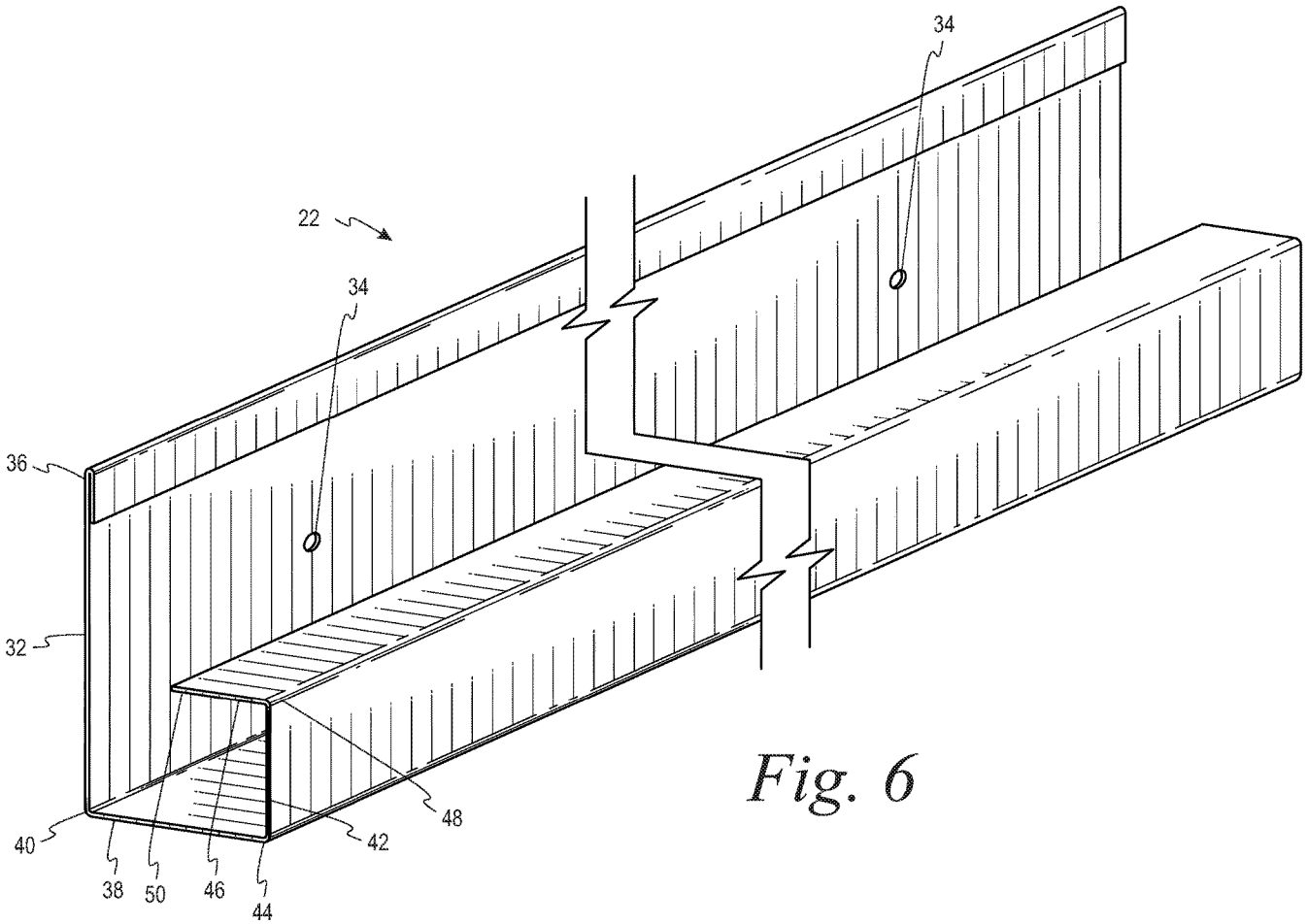
FIG. 6 is a perspective view of a perimeter molding in accordance with the present disclosure.
Figures 7, 8:
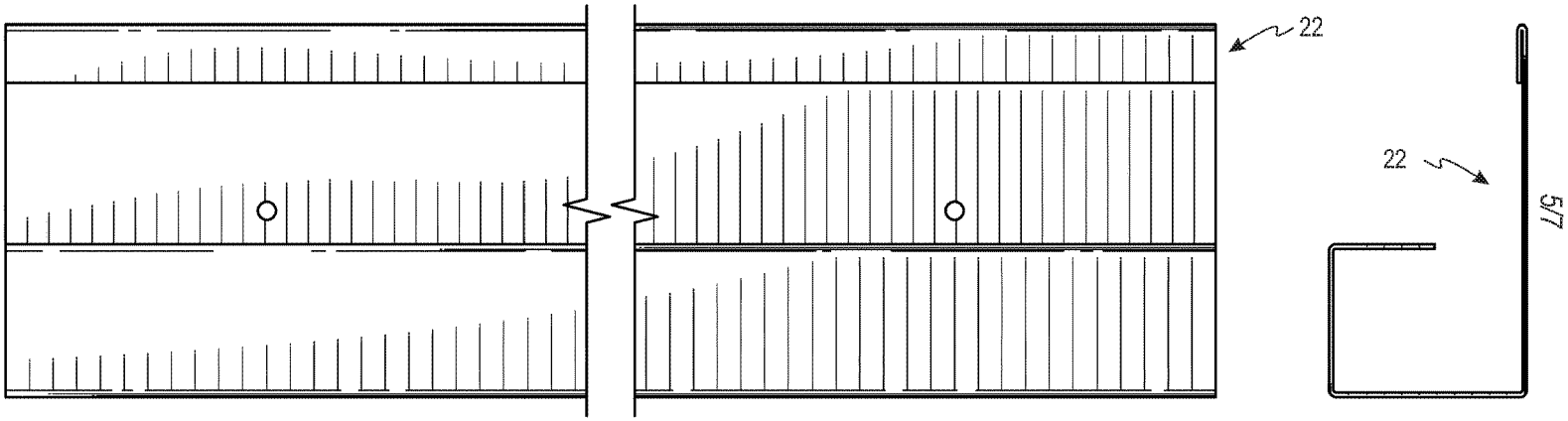
FIG. 7 is a front view of the perimeter molding of FIG. 6.
FIG. 8 is an end view of the perimeter molding taken from the right-hand side of FIG. 7.
Figure 10:
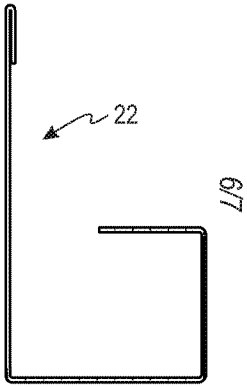
FIG. 10 is an end view of the perimeter molding taken from the left-hand side of FIG. 7.
Figure 9:
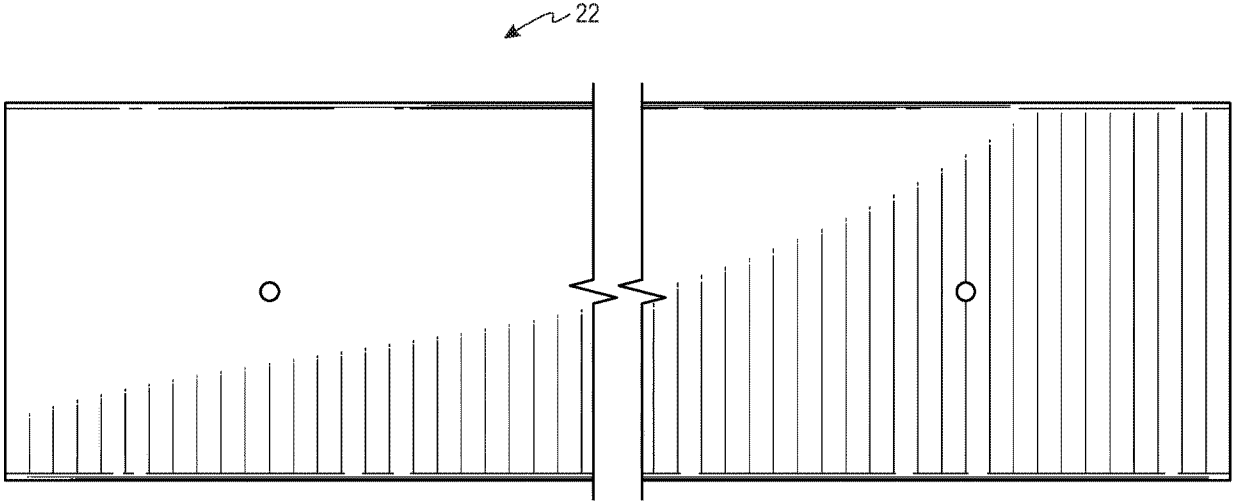
FIG. 9 is a rear view of the perimeter molding of FIG. 6.
Figure 11:
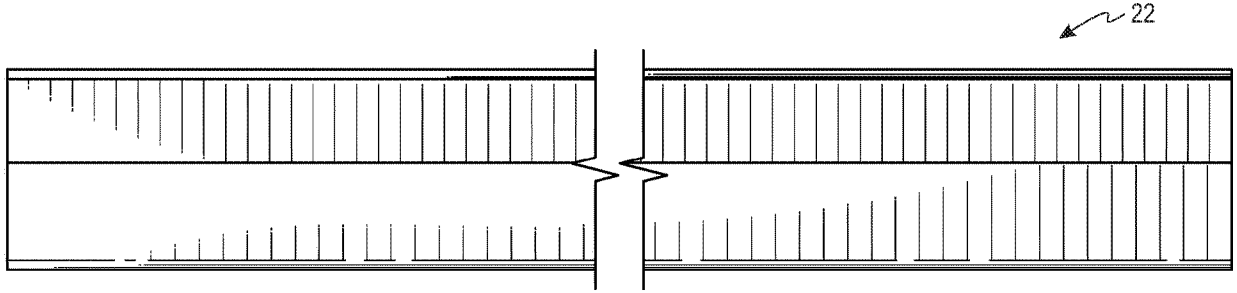
FIG. 11 is a top view of the perimeter molding of FIG. 6.
Figure 12:
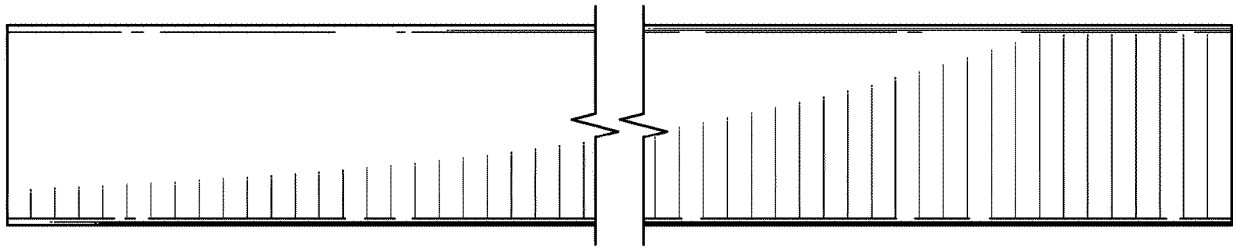
FIG. 12 is a bottom view of the perimeter molding of FIG. 6.

In keeping with the disclosure and as best seen in FIGS. 4-6, the perimeter molding 22 comprises an elongated, longitudinally-extending metal body, with a first generally planar vertical leg 32 by which the perimeter molding 22 is secured to the wall by, e.g., threaded fasteners that are received in apertures 34 in the first vertical leg 32. The first vertical leg 32 has an upper end and a lower end, the upper end of the first vertical leg 32 of the perimeter molding 22 preferably comprising a longitudinally extending stiffening element 36. As illustrated, the stiffening element 36 is formed by folding the upper end of the vertical leg 32 back on itself. However, other means may be used as would occur to a person skilled in the art.

A first generally planar horizontal leg 38 extends from the lower end of the first vertical leg 36. The first horizontal leg 38 has a first end and a second end, with the lower end of the first vertical leg 32 and the first end of the first horizontal leg 38 intersecting at a first corner 40.

A second generally planar vertical leg 42 extends from the second end of the first horizontal leg 38. The second vertical leg 42 also has a lower end and an upper end, with the second end of the first horizontal leg 38 and the lower end of the second vertical leg 42 intersecting at a second corner 44.

A second generally planar horizontal leg 44 extends from the upper end of the second vertical leg 42 toward the first vertical leg 32. The second horizontal leg 46 has a first end and a second end, and, the first end of the second horizontal leg 46 and the upper end of the second vertical leg 42 intersect at a third corner 48. As illustrated, the second end of the second horizontal leg 46 is a free end 50 spaced from the first vertical leg 32.

As noted above, and as best seen in FIGS. 2 and 3, the ceiling panels 18 associated with the suspension grid are of the type in which the lower, visible face of the ceiling panels 18 is in a plane below the plane defined by the lower faces of the opposed flanges 20 of the main runners 12 and cross tees 14. With reference to FIG. 2, the edges of the ceiling panel 18 are additionally configured to conceal the grid, while the lower faces of the grid members remain visible with the edge configuration of the panels 18 shown in FIG. 3.

The vertical dimension "A" of the second vertical leg 42 of the perimeter molding 22, shown in FIGS. 4 and 5, may vary depending on the thickness and edge configuration of the ceiling panels 18 being used in the ceiling system. The vertical dimension A should be at least sufficient to cause the visible lower face of the ceiling panels 18 supported by the grid system to be flush with the first horizontal leg 38 of the perimeter molding 22, thus covering or obscuring the straight cut edge of any ceiling panel 18 located at the perimeter of the ceiling system. However, the vertical dimension A of the second vertical leg 42 could be greater than that described above, so that the first horizontal leg 38 of the perimeter molding 22 is disposed in a plane below that of the visible lower faces of the ceiling panels 18, as such a dimension would still serve to conceal the straight cut edge of the perimeter ceiling panels 18.

When the ceiling system is installed in areas where seismic activity is a concern, a perimeter clip, may be used to stabilize the perimeter of the grid components. An exemplary perimeter clip is shown in U.S. Pat. No. 7,552,567, which is incorporated herein by reference. Such a clip would serve to secure the main runner 12 to the first vertical leg 32 of the perimeter molding 22, while permitting a pre-determined amount of relative movement between the main runner 12 and the perimeter molding 22 in the event of a seismic occurrence. To accommodate such a perimeter clip, the height of the first vertical leg 32 that extends above the upper surface of the second horizontal leg 46, shown as "B" in FIGS. 4 and 5, should be a fixed dimension. Thus, while dimension A may vary depending on the configuration of the ceiling panels 18 used in the ceiling system 10, dimension B is preferably the same regardless of the configuration of the ceiling panels 18 so that a perimeter clip may be used if necessary. By making sure that the height of the first vertical leg is at least sufficient to mount such a perimeter clip, the perimeter molding has increased profile stiffness, and also provides a larger vertical surface for the ceiling panels to bear against should they be dislodged or shifted due to a seismic event.

Thus, an improved suspended ceiling system and perimeter molding have been provided. It will be understood that the embodiments described above are illustrative of some of the applications of the present subject matter. Numerous modifications may be made by those skilled in the art without departing from the spirit and scope of the claimed subject matter, including those combinations of features that are individually disclosed or claimed herein. For these reasons, the scope of the disclosure is not limited to the above, description, but is set forth in the following claims.

The invention claimed is:

1. A perimeter molding for a suspended ceiling grid system comprising an elongated, longitudinally-extending metal body having:

a) a first planar vertical leg having an upper and lower end and configured to be secured to a wall;

b) a first planar horizontal leg having a first end and a second end, and extending from the lower end of the first vertical leg, the lower end of the first vertical leg and the first end of the first horizontal leg intersecting at a first corner;

c) a second planar vertical leg having a lower end and an upper end, and extending from the second end of the first horizontal leg, the second end of the first horizontal leg and the lower end of the second vertical leg intersecting at a second corner; and d) a second planar horizontal leg consisting of a first end and a second end, and extending from the upper end of the second vertical leg toward the first vertical leg, the first end of the second horizontal leg and the upper end of the second vertical leg intersecting at a third corner, the second end of the second horizontal leg being a free end spaced apart from the first vertical leg, the free end having no further leg extending therefrom.

2. A perimeter molding for a suspended ceiling grid system comprising an elongated, longitudinally-extending metal body having:

a) a first planar vertical leg having an upper and lower end and configured to be secured to a wall;

b) a first planar horizontal leg having a first end and a second end, and extending from the lower end of the first vertical leg, the lower end of the first vertical leg and the first end of the first horizontal leg intersecting at a first corner;

c) a second planar vertical leg having a lower end and an upper end, and extending from the second end of the first horizontal leg, the second end of the first horizontal leg and the lower end of the second vertical leg intersecting at a second corner; and d) a second planar horizontal leg having a first end and a second end, and extending from the upper end of the second vertical leg toward the first vertical leg, the first end of the second horizontal leg and the upper end of the second vertical leg intersecting at a third corner, the second end of the second horizontal leg being a free end spaced apart from the first vertical leg, the free end having no further leg extending therefrom.

3. The perimeter molding of claim 2 wherein the first vertical leg has a first vertical dimension and the second vertical leg has a second vertical dimension, the first vertical dimension being greater than the second vertical dimension.

4. The perimeter molding of claim 2 wherein the upper end of the first vertical leg comprises a longitudinally extending stiffening element.

5. A suspended ceiling system comprising a grid of tees, ceiling tiles supported on the tees, a perimeter molding supporting the tees and the tiles adjacent a wall to which the wall molding is secured, the perimeter molding comprising an elongated, longitudinally-extending metal body having a first planar vertical leg having an upper and lower end and configured to be secured to the wall; a first planar horizontal leg having a first end and a second end, and extending from the lower end of the first vertical leg, the lower end of the first vertical leg and the first end of the first horizontal leg intersecting at a first corner; a second planar vertical leg having a lower end and an upper end, and extending from the second end of the first horizontal leg, the second end of the first horizontal leg and the lower end of the second vertical leg intersecting at a second corner; and a second planar horizontal leg having a first end and a second end, and extending from the upper end of the second vertical leg toward the first vertical leg, the first end of the second horizontal leg and the upper end of the second vertical leg intersecting at a third corner, the second end of the second horizontal leg being a free end spaced apart from the first vertical leg, the free end having no further leg extending therefrom.

6. The suspended ceiling system of claim 5 wherein the first vertical leg of the perimeter molding has a first vertical dimension and the second vertical leg of the perimeter molding has a second vertical dimension, the first vertical dimension being greater than the second vertical dimension.

7. The suspended ceiling system of claim 5 wherein the upper end of the first vertical leg of the perimeter molding comprises a longitudinally extending stiffening element.

8. The suspended ceiling system of claim 5 wherein the ceilings tiles supported in the grid of tees adjacent to the wall have an edge adjacent to and abutting the second planar vertical leg of the perimeter molding, said edge consisting of a vertical surface.

9. The suspended ceiling system of claim 5 in which the grid tees comprise opposed flanges at lower ends thereof that are supported on the second horizontal leg of the perimeter molding.

10. The suspended ceiling system of claim 9 wherein the ceiling tiles have a lower face that lie in plane below a first plane defined by the second horizontal leg of the perimeter molding and in or above a second plane defined by the first horizontal leg of the perimeter molding.

* * * * *